United States Patent [19]

Kemeny et al.

[11] Patent Number: 4,987,821

[45] Date of Patent: Jan. 29, 1991

[54] ELECTROMAGNETIC PROJECTILE LAUNCHER WITH ENERGY RECOVERING AUGMENTING FIELD AND MINIMAL EXTERNAL FIELD

[75] Inventors: George A. Kemeny, Wilkins Twp.; Fred J. Baehr, Jr., Export, both of Pa.

[73] Assignee: Westinghouse Electric Corp., Pittsburgh, Pa.

[21] Appl. No.: 256,745

[22] Filed: Apr. 23, 1981

[51] Int. Cl.[5] ..... F41F 1/00; F41F 1/01; F41F 7/00

[52] U.S. Cl. ..... 89/8; 124/3; 310/11

[58] Field of Search ..... 89/8; 124/3; 310/11

[56] References Cited

U.S. PATENT DOCUMENTS 1,370,200 3/1921 Fauchon-Villepleé ..... 89/8
4,343,223 8/1982 Hawke et al. ..... 89/8

OTHER PUBLICATIONS

LA-8000-C, Proceedings of the Impact Fusion Workshop, Los Alamos, N.M. (7/79), pp. 160, 206-217, Electromagnetic Accelerator Concepts, Kolm.

*Primary Examiner*—Sal Cangialosi
*Attorney, Agent, or Firm*—Fred J. Baehr, Jr.

[57] ABSTRACT

An electromagnetic projectile launcher with augmenting conductors and a circuit breaker at the breech which closes as the projectile is launched to recover inductive energy from the launching rails for successive shots and a launcher with coaxial conductors which greatly reduce external flux.

32 Claims, 5 Drawing Sheets

ELECTROMAGNETIC PROJECTILE LAUNCHER WITH ENERGY RECOVERING AUGMENTING FIELD AND MINIMAL EXTERNAL FIELD

BACKGROUND OF THE INVENTION

This invention relates to electromagnetic projectile launching and more particularly to an electromagnetic projectile launcher with an augmenting field and switching which recovers energy from the launching rails and coaxial conductor arrangements which minimize the external field.

In rapid or burst firing of projectiles utilizing electromagnetic forces drastic means are required to prevent overheating of the projectile rails. Augmenting the projectile rails with conductors carrying current in the same direction as it flows in the projectile rails reduces the current necessary to attain a predetermined propelling force. The ohmic heating of the rails is proportional to the square of the current so that a reduction in current can advantageously result in lower temperature rises and smaller conductors. Furthermore, a substantial fraction of the inductive energy remains stored in the launching rails and must be dissipated after each shot thus rapid recovery of the post projectile acceleration inductive rail energy conserves energy, increases time available for reloading, and results in less heating of the launching rails.

A coaxial arrangement of the conductive rails substantially reduces external magnetic flux even during the period when inductive energy is being built up in the augmenting rails.

SUMMARY OF THE INVENTION

In general, an electromagnetic projectile launcher, when made in accordance with this invention, comprises a first pair of conductors having a breech end and a muzzle end, means for conducting current between the first pair of conductors and for propelling a projectile from the breech to the muzzle end of the first pair of conductors, a second pair of conductors electrically connected to the first pair of conductors and respectively disposed so that the current in adjacent conductors in each pair flows in the same direction. The electromagnetic projectile launcher also comprises a source of high current connected to the conductors, a switch disposed between the first pair of conductors adjacent the breech end thereof. The switch is operable to close when the current conducting and projectile propelling means is in the vicinity of the muzzle end of the first pair of conductive rails. The conductors may be disposed in a coaxial configuration to reduce external flux.

BRIEF DESCRIPTION OF THE DRAWINGS

The objects and advantages of this invention will become more apparent from reading the following detail description in conjunction with the following drawings, in which.

DESCRIPTION OF THE PREFERRED EMBODIMENTS

Figure 1:
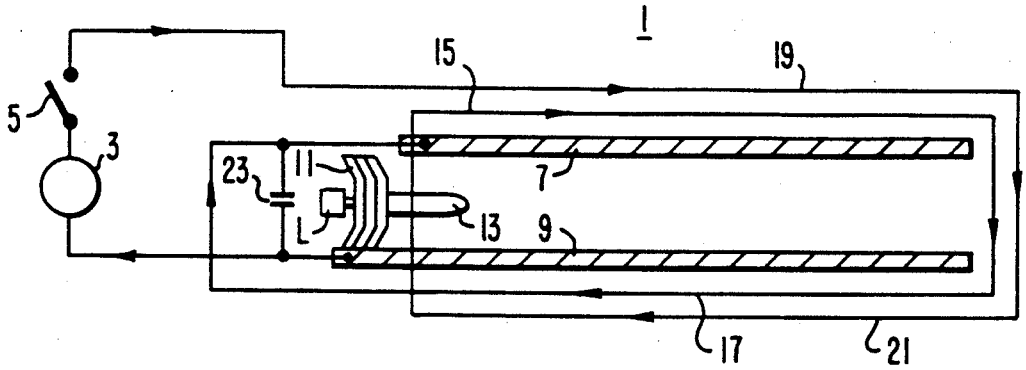
FIG. 1 is a schematic diagram of an electromagnetic projectile launching system made in accordance with this invention.

Referring now to the drawings in detail and in particular to FIG. 1 there is shown an electromagnetic projectile launching system 1 comprising a series circuit having a supply or source of high current such as a homopolar generator 3 or other generating means including a pulse generator, a make switch 5, a plurality of pairs of conductors disposed parallel to one another and connected in series so that one conductor of each pair is so connected in series that the current in one group flows in one direction and the current in the other group flows in the opposite direction or the pairs being so arranged that conductors from each pair are disposed parallel to one another and adjacent each other so that the current in adjacent conductors flows in the same direction.

A first pair of conductors 7 and 9 serve as conductive rails and have a breech end and a muzzle end. An armature 11 or other conductive means including an arc conducts currents between the conductive rails 7 and 9 and propels a projectile 13 from the breech to the muzzle end of the conductive rails 7 and 9. Augmenting pairs of conductors 15 and 17 and 19 and 21 are disposed adjacent the conductive rails 7 and 9 to store inductive energy for the launch. Additionally, the augmenting pairs of conductors 15 and 17 and 19 and 21 increase the magnetic flux density in the bore between conductors 7 and 9 and this increased flux density increases the force propelling the projectile 13 to a level greater than would be obtained at the same current between conductors 7 and 9, but without flux augmentation.

A circuit breaker 23 is disposed across the breech end of the conductors 7 and 9. The circuit breaker 23 may be an array of parallel connected switching means operated simultaneously or successively to handle the high currents. The breech end of the conductors 7 and 9 may have a resistive insert (not shown) or the armature 11 and projectile 13 may be inserted as the circuit breaker 23 is opened in order to commence firing. It should be noted that the small breech loop represented by the circuit breaker 23 and armature 11 is located outside the augmenting parallel conductors 15 and 19 and 17 and 21 so that the charging flux generated by the augmenting conductors does not produce a substantial electromotive force in the breech loop. If an arc is struck and is then utilized to drive the projectile 13 using a bore sealing and insulating sabot then the disposition of the breech outside the augmenting conductors is not required. If the armature and projectile are inserted to commence firing the breech may also be within the field produced by the augmenting conductors.

Figure 2:
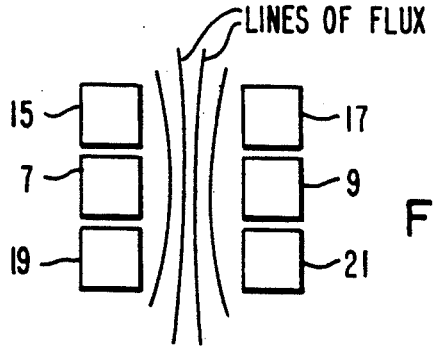
FIG. 2 is a sectional view of an arrangement of conductors.

FIG. 2 shows a particular physical disposition of these conductors.

Figure 3:
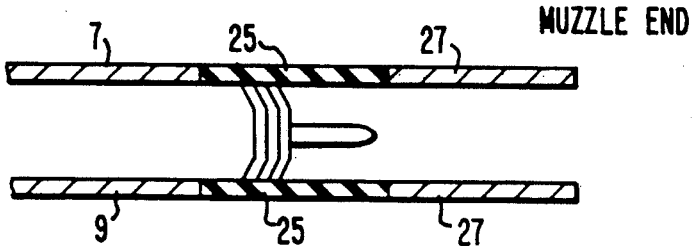
FIG. 3 is a plan view of the muzzle end of the launching rails.

As shown in FIG. 3 the muzzle end of the conductive rails 7 and 9 preferably have a high resistance portion 25 and an arc resistant insulation portion 27 to assist in transferring the inductive energy in the rails 7 and 9 back to the augmenting rails 15 and 17 and 19 and 21 by reclosing the circuit breaker 23 when the projectile armature 11 and projectile 13 are in the vicinity of the muzzle end of the rails or by reclosing circuit breaker 23 at the proper time to cause efficient transfer of the inductive propelling rail energy.

Figure 4:
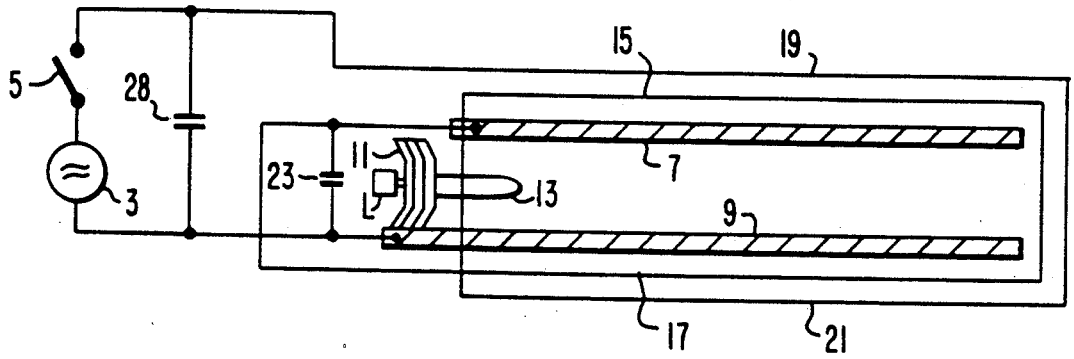
FIG. 4 is a schematic diagram of an alternative electromagnetic launching system.

FIG. 4 is similar to FIG. 1 except there is a crowbarring switch 28 connected across the current source 3 and make switch 5. The crowbarring switch 28 is utilized to stop the firing sequence along with the make switch 5 and the circuit breaker 23.

Figure 5:
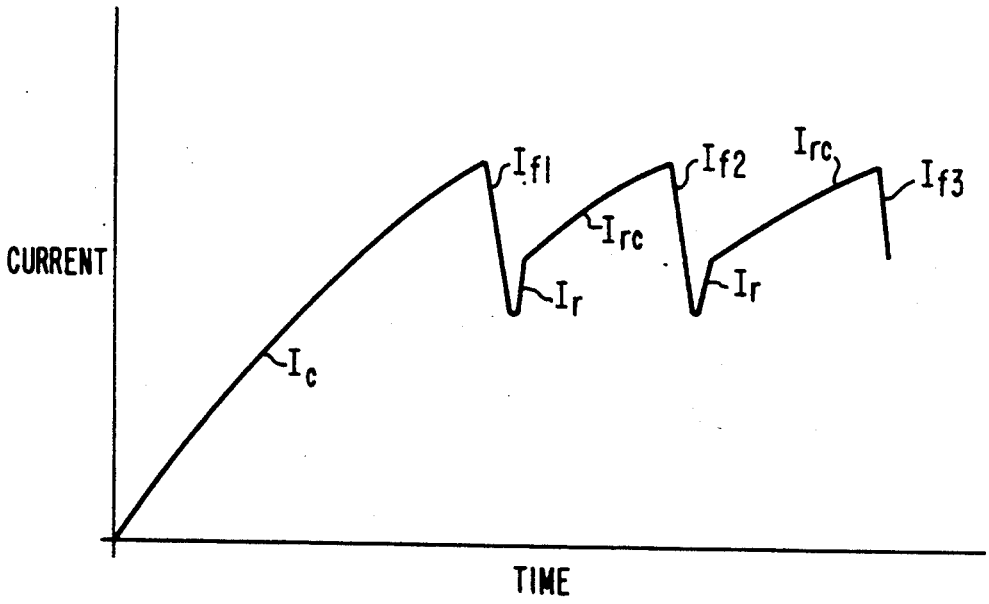
FIG. 5 is a graph estimating current variation versus time for successive firings.

FIG. 5 shows an idealized curve of current versus time for successive firings. The initial charging of the augmenting conductors 15 and 17 and 19 and 21 is indicated by $I_c$. The decrease in current during the first firing is indicated by $I_{f1}$. $I_r$ indicates the current or energy recovered as the inductive energy in the firing rails 7 and 9 is recovered by closing the circuit breaker 23 as the armature 11 and projectile 13 are in the vicinity of the muzzle end of the rails 7 and 9. $I_{rc}$ is the current rise as the augmenting rails 15 and 17 and 19 and 21 are recharged prior to subsequent firing.

Figure 6:
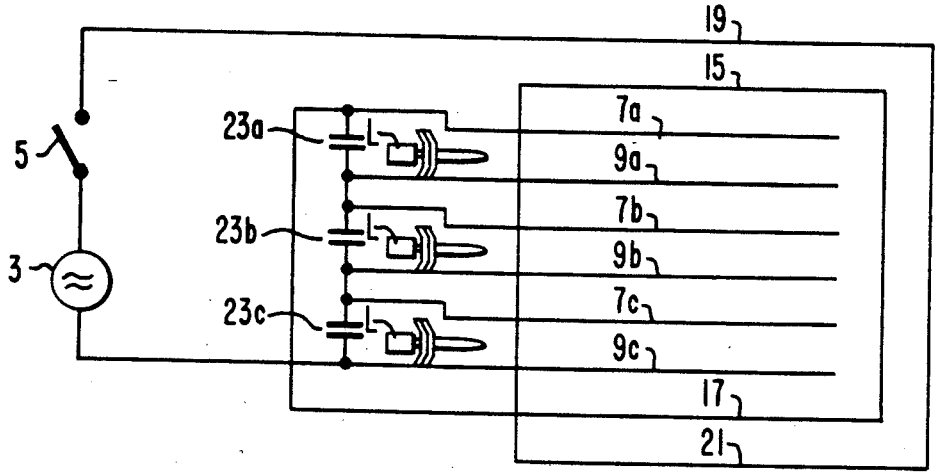
FIG. 6 is a schematic diagram of a multi-barrel electromagnetic launching system.

FIG. 6 is a schematic diagram of an electromagnetic projectile launching system utilizing a plurality of launching rails 7*a* and 9*a*, 7*b* and 9*b*, and 7*c* and 9*c* with circuit breakers 23*a*, 23*b*, and 23*c* respectively connected across the breech end of the launching rails. The circuit breakers 23*a* 23*b*, and 23*c* are opened to fire and closed to recover the inductive energy in the projectile rails 7 and 9*a*, *b*, *c* respectively as the projectile is in the vicinity of the muzzle end of the rails or when the desired projectile acceleration has been substantially achieved. When circuit breaker 23*a*, *b*, or *c* is opened to fire, the corresponding armature 11 and projectile 13*a*, *b* or *c* is pushed concurrently into the conducting breech by loading means *a*, *b* or *c*.

Figure 8A:
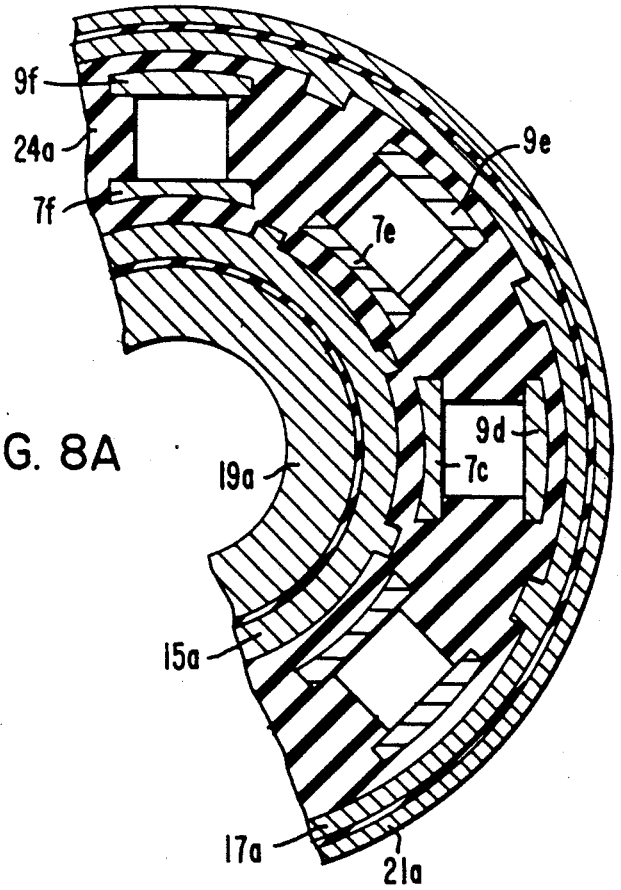
FIGS. 8 and 8A are sectional views of arrangement of conductors.
Figure 8:
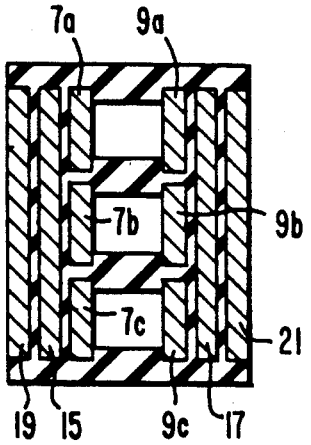

FIG. 8 shows a physical arrangement of conductors for such a system. The launching rails 7*a* and 9*a*, 7*b* and 9*b* and 7*c* and 9*c* are disposed with insulation 24 between adjacent pairs and the augmenting rails 15 and 17 and 19 and 21 are disposed outboard of the projectile rails with insulation disposed between adjacent rails. All the rails may be flat bars disposed parallel to one another.

FIG. 8A shows a similar physical arrangement of conductors. The launching rails 7*d* and 9*d*, 7*e* and 9*e*, and 7*f* and 9*f* are disposed within an annulus of insulation 24*a* forming a plurality of barrels or bores. Augmenting conductors 15*a* and 17*a* and 19*a* and 21*a* are coaxially disposed on opposite sides of the annulus of insulation 24*a* to substantially reduce external flux.

Figure 7:
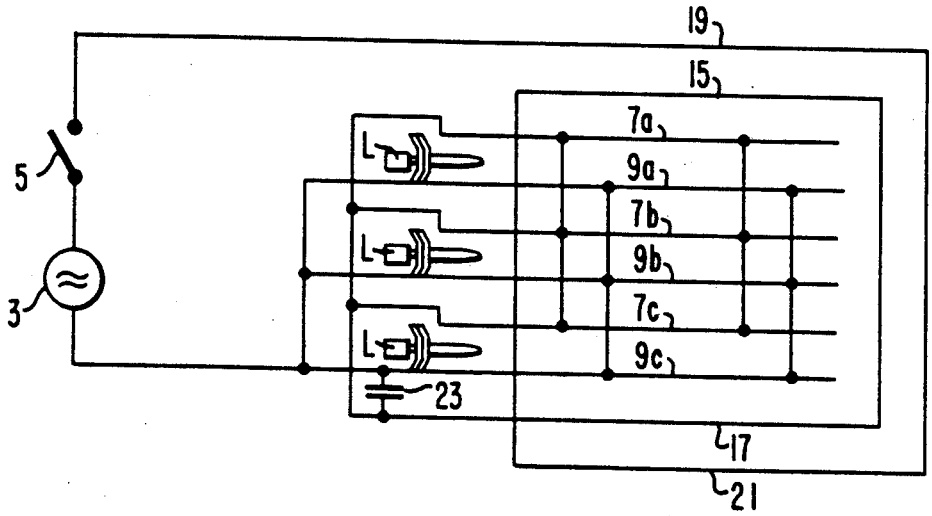
FIG. 7 is a schematic diagram of an alternative multi-barrel electromagnetic launching system.

FIG. 7 is a schematic diagram of an electromagnetic projectile launching system similar to the one shown in FIG. 6 except that there is a single circuit breaker 23 and the rails 7 and 9 are connected in parallel or are integral conductors forming a plurality of barrels or bores with insulation separating and defining the barrels or bores.

Figure 9:
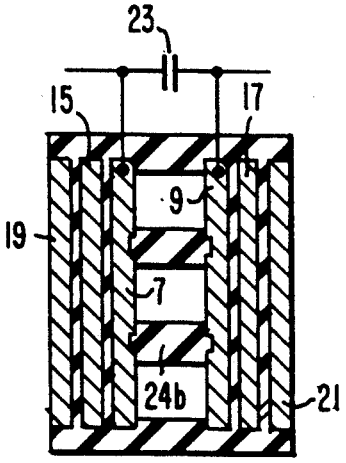
FIG. 9 is a sectional view of an alternative conductive conductor arrangement.

FIG. 9 shows one physical arrangement of flat conductors disposed parallel to one another with insulating blocks 24*b* separating a plurality of barrels or bores disposed between the conductors 7 and 9. The electrical connections for the conductors illustrated in cross-section in FIG. 9 may be as illustrated in FIG. 7.

Figure 10:
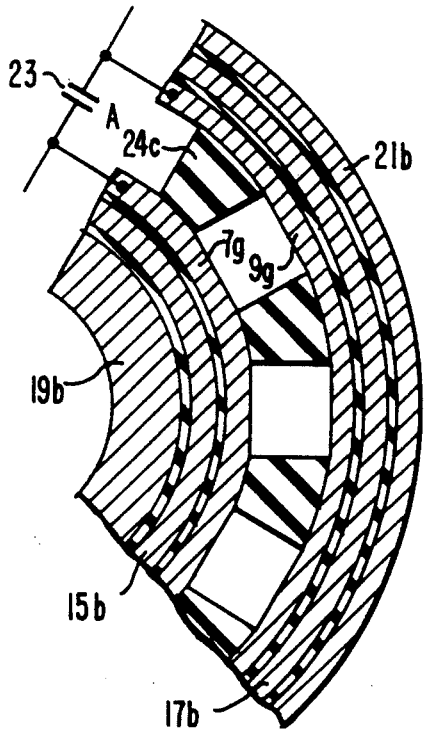
FIG. 10 is a sectional view of a coaxial conductor arrangement.

FIG. 10 shows a similar physical arrangement utilizing tubular conductors 7*g* and 9*g*, 15*b* and 17*b*, and 19*b* and 21*b* coaxially disposed which advantageously substantially reduce external flux and provide a lightweight yet a mechanically strong arrangement for multiple barrels separated by insulating blocks 24*c* not necessitating external support or restraint.

Figure 11:
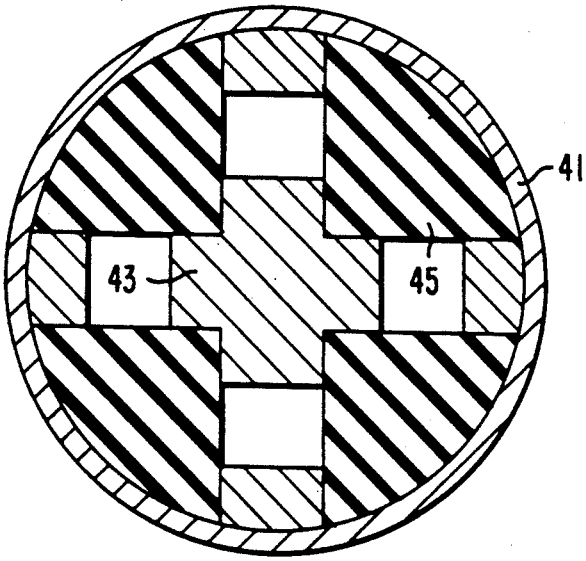
FIG. 11 is a sectional view of an alternative coaxial conductor arrangement.

FIG. 11 shows a multi-barrel projectile launcher having coaxial conductors which include an outer tubular conductor 41 and a central conductor 43 having a cruciform-shaped cross-section with insulation 45 holding the central cruciform-shaped conductor 43 within the outer tubular conductor 41 and providing a plurality of bores for firing a plurality of projectiles. Since all barrels share the same conductors, projectiles 13 and armatures 11 are inserted or moved to conductive portions of the barrel to commence firing. The power source for such an electromagnetic projectile launcher could comprise a pulse source which would generate pulses of voltages or it could be a homopolar generator and an inductive energy storage device, which represents a pulse current source. While a cruciform-shaped central conductor is shown it is understood that the central conductor may be any shape depending on the number of barrels desired. The advantage of the coaxial arrangement is that this arrangement provides high strength with a minimal amount of material not requiring external support and the coaxial arrangement reduces external flux. The external conductor may also be maintained essentially at ground potential except during the brief period that the projectile traverses the barrel.

The series connection of a homopolar or other direct current generator of a battery array and inductive energy storage, for example the inductive energy storage provided by the augmenting conductor pairs in FIGS. 1, 4, 6 and 7 in combination with a circuit breaker or firing switch 23 represents a pulse current source. The kinetic energy of the homopolar machine is entirely or intermittently transferred to the inductive storage .which stores energy in its magnetic field by virtue of the current which generates and maintains this field. When the circuit breaker 23 is opened, the voltage appearing across the switch terminals commutates or injects the current into the electrically in-parallel projectile rails and the armature, thus initiating acceleration of the projectile. To ease and speed up the current commutation or injection, the initial current path through the rails and armature should be in close proximity of the switch 23. During the projectile acceleration, the propelling energy is primarily provided from the inductive storage and the breech voltage, which is generally far in excess of the homopolar machine voltage, is also generated primarily by the inductive storage. In the FIGS. 1 and 4 circuits, if an attempt were made to open circuit breaker 23 without there being available an alternative path for the current, such as the breech current loop through the armature, then current flow through circuit breaker 23 would not stop until the inductive energy storages is depleted which occurs at a current zero. Thus, if the switch 23 is opened without armature 11 shorting the breech, arcing at the switch 23 will continue and the switch will most likely fail, or the switch must sense the absence of commutation and quickly reclose, or arc breakdown to preserve current flow will occur somewhere in the circuit, or other provisions need be made to provide the required parallel alternative current path, for example, a parallel-connected lightning-arrester type of device. Likewise, when inductive energy is stored in the augmenting conductors of FIG. 6, and if then switch 23*a* is opened, armature 11*a* has to short the conducting rails 7*a* and 9*a* at the breech so that current can be injected into this breech loop. In FIG. 7, when switch 23 is opened, at least one of the armatures must bridge across a breech rail bore so that current can be commutated into this armature. If more than one armature shorts across the breech bores during current injection, two armatures will be accelerated but this will in general be unsatisfactory because current need not divide equally between the two bores leading to the likelihood of unequal velocities for the two projectiles.

A suitable pulse voltage source can be a rotating machine which generates distinct voltage pulses. The suitability of the voltage pulse here implies only that if a projectile is in the breech across which the voltage pulse is applied, that pulse will in turn result in the desired current magnitude and duration to cause the desired projectile acceleration. With such a voltage pulse source connected, for example, between the inner and outer conductors of FIG. 11, a single projectile will be accelerated if it shorts across conductors when the voltage pulse is applied across the conductors. With a pulse voltage source, if there is no projectile to short across conductors, no current will flow and no energy need be wasted. With a voltage pulse source, the inductive storage is generally self-contained in the internal electrical and magnetic circuitry of the rotating pulse generating machine and with no external inductive storage being required, such a pulse generator is ideal for coupling to a FIG. 11 type of barrel which requires no external inductive storage as there are no augmenting conductors.

In the augmented electromagnetic projectile launching systems, as shown for example in such FIGS. as 1, 2, 4, 6 and 7 a closed launch rail loop is formed which includes the launching rails 7 and 9, the closed circuit breaker or firing switch 23 and the armature or a muzzle arc in the final launching stage or just after launching. The current flowing in this closed loop and its inductance result in energy storage in this loop, essentially the post-launch projectile rail inductive energy. Because the augmenting conductor pairs 15 and 17 and 19 and 21 link substantially the same magnetic flux, rapidly impeding or interrupting current flow in the launch rail loop results in the transfer of current or energy back to the augmenting conductors thus allowing this energy to be preserved for successive firings. The efficient transfer of energy back into the augmenting rails will be increased by a compact design of projectile and augmenting rails and by having essentially all of the prelaunch inductive energy stored in the augmenting conductors and not in external circuit inductance and by having a design whereby the augmenting rail pairs substantially link all the magnetic flux of the projectile propelling conductors and by closing the circuit breaker 23 just before, as, or right after the armature 11 exits from the muzzle and then or concurrently rapidly impeding the current flow in the launch rails 7 and 9 after the armature 13 has exited or is about to exit.

FIGS. 9 and 10 advantageously show large conductors relative to bore size to further improve the efficiency by reducing ohmic losses in the conductive rails.

FIGS. 8A, 10 and 11 advantageously show coaxial conductive rails which have very little external flux and provide strong self-supporting structures. The outer portion of the outermost conductor may furthermore be a high strength material with poor conductivity or may be non-conductive and may then serve as structural reinforcement only.

What is claimed is:

1. An electromagnetic projectile launcher comprising:

a first pair of conductors having a breech end and a muzzle end;

means for conducting current between said fist pair of conductors and for propelling a projectile from the breech to the muzzle end of said first pair of conductors;

a second pair of conductors electrically connected to said first pair of conductors and respectively disposed alongside said first pair of conductors so that the current in adjacent conductors of each pair flows in the same direction and so that the magnetic flux produced by the current in the adjacent conductors of the first and second pairs is substantially linked;

a source of high current connected to said conductors for supplying high current thereto;

switching means disposed between said first pair of conductors adjacent the breech end thereof;

said switching means being operable to open to allow high current to flow to said current conducting and projectile propelling means to launch said projectile and to close when said current conducting and projectile propelling means is in the vicinity of the muzzle end of said first pair of conductors.

2. An electromagnetic projectile launcher as set forth in claim 1, wherein the second pair of conductors does not extend to the breech end of the first pair of conductors.

3. An electromagnetic projectile launcher as set forth in claim 1, wherein the first pair of conductors has means for increasing the electrical impedance adjacent the muzzle end thereof.

4. An electromagnetic projectile launcher as set forth in claim 1, wherein the first pair of conductors are conductive rails contacted by said current carrying and projectile propelling means and the second pair of conductors are augmenting conductors which augment the magnetic field.

5. An electromagnetic projectile launcher as set forth in claim 4, wherein there are a plurality of pairs of conductive rails.

6. An electromagnetic projectile launcher as set forth in claim 4, wherein there are a plurality of pairs of augmenting conductors.

7. An electromagnetic projectile launcher as set forth in claim 5, wherein there are a plurality of pairs of augmenting conductors.

8. An electromagnetic projectile launcher as set forth in claim 6, wherein the conductors are coaxially dispersed to substantially reduce external flux.

9. An electromagnetic projectile launcher as set forth in claim 5 wherein the pairs of conductive rails are connected in parallel.

10. An electromagnetic projectile launcher as set forth in claim 4 wherein the augmenting conductors provide substantially all of the inductive energy storage,.

11. An electromagnetic projectile launcher as set forth in claim 5 wherein each pair of conductive rails has added resistance disposed adjacent the muzzle ends thereof.

12. An electromagnetic projectile launcher as set forth in claim 1 wherein both pairs of conductors are coaxially disposed with electrical insulation disposed between adjacent conductors.

13. An electromagnetic projectile launcher as set forth in claim 12, wherein the electrical insulation between the first pair of conductors is so disposed to provide a plurality of openings extending from the breech to the muzzle end thereof to form a plurality of bores for a plurality of projectiles.

14. An electromagnetic projectile launcher as set forth in claim 6, wherein electrical insulating material is so disposed between the first pair of conductors to provide a plurality of openings extending from the breech to the muzzle end thereof to form a plurality of barrels for a plurality of projectiles.

15. An electromagnetic projectile launcher comprising:

a pair of coaxial conductors having a breech and a muzzle end, wherein at least one of said conductors is tubular and the other conductor of said pair is disposed within said tubular conductor;

a source of high current connected to said conductors;

means for conducting current between conductors and for propelling a projectile from the breech end to the muzzle end of said conductors;

insulation disposed between said conductors to form a plurality of openings generally extending from the breech to the muzzle end of said conductors;

said insulation providing a rigid structure separating said conductors and resulting in forming a plurality of bores between said conductors for launching projectiles whereby the external field is minimized.

16. An electromagnetic projectile launcher as set forth in claim 15, wherein the internal conductor of the coaxial pair may have generally any shape and the external coaxial conductor has a generally cylindrical outer surface.

17. An electromagnetic projectile launcher as set forth in claim 15, wherein the coaxial conductors are tubular, and further comprising a plurality of pairs of conductive rails disposed in said bores and insulating from said coaxial conductors.

18. An electromagnetic projectile launcher as set forth in claim 15, wherein the inner coaxial conductor has a cruciform cross-section.

19. An electromagnetic projectile launcher as set forth in claim 18, wherein the outer coaxial conductor is tubular and has a generally cylindrical outer surface.

20. An electromagnetic projectile launcher as set forth in claim 15, wherein the first pair of coaxial conductors are tubular.

21. An electromagnetic projectile launcher as set forth in claim 20 and further comprising an additional pair of coaxial conductors coaxially disposed with respect to the first mentioned pair of coaxial conductors and insulation disposed between adjacent coaxial conductors.

22. An electromagnetic projectile launcher as set forth in claim 20 and further comprising additional pairs of coaxial conductors coaxially disposed with respect to the first mentioned pair of coaxial conductors and insulation disposed between adjacent conductors.

23. An electromagnetic projectile launcher as set forth in claim 21 and further comprising added resistance adjacent the muzzle end of the first mentioned pair of conductors.

24. An electromagnetic projectile launcher as set forth in claim 22 and further comprising added resistance adjacent the muzzle end of said first mentioned pair of conductors.

25. An electromagnetic projectile launcher as set forth in claim 5, wherein the pair of augmenting conductors are coaxially disposed.

26. An electromagnetic projectile launcher as set forth in claim 7, wherein the pairs of augmenting conductors are coaxially disposed.

27. An electromagnetic projectile launcher as set forth in claim 26 and further comprising added resistance adjacent the muzzle end of the conductive rails.

28. An electromagnetic projectile launcher as set forth in claim 27, wherein substantially all of the inductive energy storage is in the augmenting conductors.

29. An electromagnetic projectile launcher as set forth in claim 26, wherein the pairs of conductive rails are disposed between coaxially disposed augmenting conductors.

30. An electromagnetic projectile launcher as set forth in claim 29 and further comprising added resistance adjacent the muzzle end of the conductive rails.

31. An electromagnetic projectile launcher as set forth in claim 15, wherein the conductors and insulation are shaped to form a plurality of substantially rectangular bores.

32. An electromagnetic projectile launcher as set forth in claim 1, wherein the first pair of conductors has an arc resistant insulated portion adjacent the muzzle end thereof.

* * * * *